US008746322B2

(12) United States Patent
Svoboda

(10) Patent No.: US 8,746,322 B2
(45) Date of Patent: Jun. 10, 2014

(54) TECHNOLOGY OF PRODUCTION OF BIMETALLIC AND MULTILAYER CASTS BY GRAVITY OR SPUN CASTING

(75) Inventor: Arnost Svoboda, Zidlochovice (CZ)

(73) Assignee: Cronite CZ S.R.O. (CZ)

( * ) Notice: Subject to any disclaimer, the term of this patent is extended or adjusted under 35 U.S.C. 154(b) by 0 days.

(21) Appl. No.: 13/522,423

(22) PCT Filed: Feb. 3, 2011

(86) PCT No.: PCT/CZ2011/000012

§ 371 (c)(1),
(2), (4) Date: Aug. 16, 2012

(87) PCT Pub. No.: WO2011/110137

PCT Pub. Date: Sep. 15, 2011

(65) Prior Publication Data

US 2012/0312495 A1 Dec. 13, 2012

(30) Foreign Application Priority Data

Feb. 4, 2010 (CZ) ..... 2010-88

(51) Int. Cl.
*B22D 19/16* (2006.01)

(52) U.S. Cl.
USPC ..... 164/95

(58) Field of Classification Search
USPC ..... 164/91, 94, 95, 66.1
See application file for complete search history.

(56) References Cited

U.S. PATENT DOCUMENTS

| | | | | |
|---|---|---|---|---|
| 3,192,581 | A | 7/1965 | Sylvester | |
| 4,635,701 | A * | 1/1987 | Sare et al. | 164/102 |
| 2006/0260778 | A1 * | 11/2006 | Davis et al. | 164/56.1 |

FOREIGN PATENT DOCUMENTS

| | | | |
|---|---|---|---|
| DE | 21 39 880 | A1 | 2/1973 |
| DE | 101 13 962 | | 10/2002 |
| EP | 0 130 626 | A2 | 1/1985 |
| EP | 0 348 300 | | 12/1989 |
| EP | 1 462 194 | | 9/2004 |
| JP | 58032543 | | 2/1983 |
| JP | 1 066061 | A | 3/1989 |
| JP | 7308742 | | 11/1995 |
| WO | WO 2009/126095 | A1 | 10/2009 |

OTHER PUBLICATIONS

International Search Report and Written Opinion dated Aug. 17, 2011 issued in corresponding international patent application No. PCT/CZ2011/000012.

English translation of the sections deemed most important by the Applicant for JP 5832543 which was previously cited in an Infoimation Disclosure Statement filed Jul. 16, 2012.

* cited by examiner

*Primary Examiner* — Kevin P Kerns
(74) *Attorney, Agent, or Firm* — Ostrolenk Faber LLP

(57) ABSTRACT

Technology of production of bimetallic and multilayer casts by gravity or spun casting, at which at least two different metal materials are being gradually cast into the mold, while before casting of the second material there is started feeding of a flame into the mold and the flame is created by stream of aflame inflammable gas. Stream of aflame inflammable gas is created by hydrogen flame.

4 Claims, No Drawings

TECHNOLOGY OF PRODUCTION OF BIMETALLIC AND MULTILAYER CASTS BY GRAVITY OR SPUN CASTING

CROSS REFERENCE TO RELATED APPLICATIONS

The present application is a 35 U.S.C. §371 National Phase conversion of PCT/CZ2011/000012, filed Feb. 3, 2011, which claims benefit of Czech application no. PV 2010-88, filed Feb. 4, 2010, the disclosures of which are incorporated herein by reference. The PCT international application was published in the English language.

TECHNICAL FIELD

The invention relates to the technology of production of bimetallic and multilayer casts by gravity or spun casting, at which at least two different metal materials are being gradually cast into the mould, while before casting of the second material there is started feeding of a flame into the mould and the flame is created by stream of aflame inflammable gas.

BACKGROUND ART

Bimetallic or multilayer casts, which are cast from two or more different metallic materials, e.g. of various alloys, namely so that two or more materials are poured into one and the same mould. At first the first material is poured, which creates the first layer of the cast and after a certain dwell into the same mould the second material is poured, which creates the second layer, possibly analogically into the same mould after a further with a dwell is poured another material, which creates further layer of the cast, etc. Absolutely necessary condition for creating a high quality bimetallic or multilayer cast is achieving of a perfect diffusion joining of individual layers of the cast on the boundary of contact of individual layers. For a perfect diffusion joining of individual layers being cast with a mutual time delay, it is necessary to secure, that on the solidified, but still hot surface of the first layer, are present no oxides or oxide films at the moment of pouring the second material into the mould, or that these oxides or oxide films are not created in the fluid metal during its streaming through the sprue system and the cavity of the mould during pouring of the second material. There are known several solutions for elimination or reduction in occurrence of these oxides or oxide films.

DE 101 13 962 discloses a casting method for production of metallic parts consisting of at least two different materials, at the same time the one is a steel-based and the second is an aluminium-based. This method comprises the steps of applying of metal layer preferably on the body from the steel-based material, at the same time the metal layer is preferably the aluminium-based one, and inserting of such coated body into the casting mould before it is poured by aluminium. Before aluminium is poured, a liquid means is brought on the aluminium layer formed on surface of the steel body, which causes reduction, possibly removal, of oxygenated coating created on the metal layer, and the aluminium-based casting material upon pouring creates a metallurgic joining with metal layer. The liquid means is formed of eutectic composition consisting of K3AIF6 and KAIF4.

EP 348 300 discloses production method of parts from polymetallic composite by means of bottom casting. The part comprises at least two layers from different metal materials. Insertion covered by a layer of paraffin is hung into an ingot-mould, which by its shape corresponds to the contour of the insertion, from bottom the ingot-mould is filled with metal of a specified temperature and in a specified speed so that the metal totally floods the insertion and it produces a polymetallic ingot, which after then is hot rolled or cold rolled.

EP 1 462 194 discloses a production method of metal parts comprising at least two different materials, out of which one is on basis of a steel alloy and the second is on basis of aluminium alloy. At this method, firstly is on the body of steel based alloy created a metal layer on aluminium basis, preferably on Al—Si or FE basis. Subsequently, on such created metal layer is applied a silicone powder and/or borax ($Na_2B_4O_7$-$10H_2O$, hydrated sodium borate). After then, in such a manner coated body is positioned into the casting mould and an aluminium based alloy is poured on it.

JP 58032543, JP 1066061 and JP 7308742 disclose various applications of inert gas Ar (Argon) either in principle in a pure form, or in a mixture with 2% to 8% of hydrogen to create and maintain a non-oxidizing atmosphere in the space of future metallurgic joint of layers of various metals in one resulting metal part.

The common disadvantage of the known background art is a limited efficiency in elimination of occurrence of oxides and oxide layers.

The goal of the invention especially is to achieve a higher efficiency in elimination of undesired oxides and oxide layers, that negatively influence joining of individual layers of different materials being cast.

SUMMARY OF THE INVENTION

The goal of the invention has been achieved by a technology of production of bimetallic and multilayer casts by gravity or spun casting, whose principle consists in that, stream of aflame inflammable gas is created by hydrogen flame.

Through this technology it is achieved that by burning the flame all the oxygen presented in the mould is completely consumed, and possible oxides on surface of the layer of the previously cast material are intensively reduced, namely the oxides produced in the course of melting, in the course of pouring the material from the smelt furnace, in the course of material staying in the foundry ladle and in the course of pouring the material into the mould.

Preferred embodiments of technology, especially preferably usable inflammable gas etc., are a subject of dependent patent claims.

DESCRIPTION OF PREFERRED EMBODIMENTS

The technology for production of bimetallic and multilayer casts by gravity or spun casting will be described on an example of casting the two-layer, i.e. bimetallic, cast by means of gravity casting. Nevertheless the invention is analogically and without exerting any inventive activity applicable also to technology for production of multilayer casts produced by gravity casting and also to two- or multi-layer casts produced by spun casting.

Bimetallic and multilayer casts by means of gravity casting are poured into a mould, which comprises a cavity with sprue system, system of feeder heads and exhausts and other necessary elements for proper casting.

Into a such prepared mould the stream of aflame inflammable gas (flame) is delivered, e.g. so that to the mould there is brought a hose connected with reservoir of gas and provided on its end with a suitable burner, e.g. a steel tube etc., possibly added by a lockable valve for closing the stream of aflame inflammable gas. Exemplary the burner with streaming aflame inflammable gas is introduced into the mould cavity through the opened feeders or specially for this purpose created channel or other suitable opening (channel) performed in the mould. The stream of aflame inflammable gas is passing through the mould cavity, it consumes all the oxygen in the mould and it further escapes through the holes and channels out of the form and it further burns in a free space above the mould.

After the stream of aflame inflammable gas is introduced into the mould, the casting into the mould of the first material is commenced, at the same time the first material into the mould is poured in a required quantity, e.g. until the required height of the first material in the mould is achieved, which is secured by creating a suitable overflow in the mould, by measuring out a quantity of material in a foundry ladle, e.g. by weighing or according to the volume, etc. During the whole period of casting of the first material, the aflame inflammable gas continues to stream through the mould.

After pouring a required quantity of the first material into the mould, a respective dwell follows before a solidified coating is created on surface of the first material in the mould; while during this period the aflame inflammable gas continues to stream through the mould.

After the solidified coating on surface of the first material is created in the mould, under a continuous streaming of the aflame inflammable gas through the mould, the second material poured into the mould, that creates the second layer of the cast. In case a bimetallic, i.e. a two-layer, cast is being cast, the burner, through which into the form the aflame inflammable gas is streaming, is removed from the mould earliest in a moment of complete pouring of the whole surface of the first material by the second material, by which the streaming of the flame through the mould is stopped, and a quality diffusion joining of both materials is achieved.

If a cast with more than two layers is produced, the burner stays in the mould at minimum till the moment, when the last material being cast completely covers the whole surface, of the previous material.

In both cases the burner is removed from the mould at the latest in the moment, when the level of the last material being cast approaches to its mouth, so that the mouth of the burner is protected against flooding by the material being cast.

At spun casting of two- or multi-layer cast, the burner is axially inserted into the rotating ingot-mould, the best from the back side and sufficiently deep, so that the ignited inflammable gas passes through the whole length of the ingot-mould and gets out on both ends of the ingot-mould. In such arrangement it is not necessary to pull out the burner from the ingot-mould during pouring of the second material.

Alternatively, the stream of aflame inflammable gas is inserted into the mould only after pouring of the first material into the mould, i.e. before pouring the second material into the mould.

The inflammable gas used at technology according to this invention is preferably pure hydrogen or natural gas or propane-butane, or other inflammable gas with exothermic reaction with oxygen (acetylene, ethylene, methane, gaseous hydrocarbons, etc.), or a inflammable mixture of gases, etc.

Alternatively, flame, created by igniting of inflammable liquid, etc. is brought into the mould.

The invention is applicable at production of bimetallic or multilayer casts for various applications.

What is claimed is:

1. A method of producing bimetallic and multilayer casts by gravity or spun casting, comprising:

providing a mould having a mould cavity;

sequentially casting at least two different metal materials in the mould by pouring in the mould cavity a first molten material and then pouring in the mould cavity a second molten material over the first molten material; and feeding from a burner a flame of aflame hydrogen gas into the mould cavity at least before the starting of the pouring of the second molten material in the mould cavity, the aflame hydrogen gas passing through the mould cavity to consume all oxygen in the mould and then escaping to further burn in a free space above the mould;

wherein the burner is inserted into the mould cavity and the flame is fed into the mould cavity to consume all the oxygen in the mould cavity, and the flame is continuously fed into the mould cavity after pouring in the first molten material at least until the second molten material is poured into the mould cavity, wherein the second molten material is poured after a time delay to allow for realization of a solidified coating in the first molten material while the flame is fed into the mould, and wherein the burner comprises a tube and the aflame hydrogen is fed through the tube.

2. A method according to claim 1, wherein feeding of the flame into the mould is started before pouring of the first molten material into the mould.

3. A method according to claim 1, further comprising finishing the feeding of the flame into the mould when the second molten material covers a whole surface of the first molten material in the mould.

4. A method according to claim 1, further comprising finishing feeding of the flame into the mould when pouring of the second molten material into the mould is completed.

* * * * *